US007748364B2

(12) United States Patent
Hanneke et al.

(10) Patent No.: US 7,748,364 B2
(45) Date of Patent: Jul. 6, 2010

(54) FUEL INJECTION SYSTEM WITH A PLURALITY OF PRESSURE RESERVOIRS

(75) Inventors: Juergen Hanneke, Stuttgart (DE); Andreas Wengert, Auenwald (DE); Kurt Blank, Ebersbach (DE)

(73) Assignee: Robert Bosch GmbH, Stuttgart (DE)

( * ) Notice: Subject to any disclaimer, the term of this patent is extended or adjusted under 35 U.S.C. 154(b) by 368 days.

(21) Appl. No.: 11/719,427

(22) PCT Filed: Oct. 20, 2005

(86) PCT No.: PCT/EP2005/055412

§ 371 (c)(1),
(2), (4) Date: May 16, 2007

(87) PCT Pub. No.: WO2006/053812

PCT Pub. Date: May 26, 2006

(65) Prior Publication Data

US 2009/0145400 A1 Jun. 11, 2009

(30) Foreign Application Priority Data

Nov. 17, 2004 (DE) ..... 10 2004 055 266

(51) Int. Cl.
*F02M 69/46* (2006.01)

(52) U.S. Cl. ..... 123/456; 123/447; 123/468

(58) Field of Classification Search ..... 123/456, 123/470, 447, 468, 469
See application file for complete search history.

(56) References Cited

U.S. PATENT DOCUMENTS

| | | | | |
|---|---|---|---|---|
| 2,892,453 | A * | 6/1959 | Stoll | 123/452 |
| 3,930,483 | A * | 1/1976 | Blisko et al. | 123/457 |
| 5,058,555 | A * | 10/1991 | Haboush et al. | 123/470 |
| 5,080,069 | A * | 1/1992 | Hudson, Jr. | 123/456 |
| 5,080,070 | A * | 1/1992 | Hafner | 123/470 |
| 6,189,508 | B1 | 2/2001 | Stan | |
| 6,220,224 | B1 | 4/2001 | Matthies et al. | |
| 6,227,169 | B1 * | 5/2001 | Sato et al. | 123/456 |
| 6,494,182 | B1 * | 12/2002 | Djordjevic | 123/456 |
| 6,513,498 | B1 | 2/2003 | Frank | |
| 6,981,655 | B1 * | 1/2006 | Mattes | 239/102.2 |
| 7,249,593 | B2 * | 7/2007 | Ricco et al. | 123/456 |
| 7,278,399 | B2 * | 10/2007 | Ricco et al. | 123/447 |
| 7,305,968 | B2 * | 12/2007 | Ricco et al. | 123/456 |
| 7,509,943 | B2 * | 3/2009 | Ricco et al. | 123/456 |
| 2003/0034011 | A1 * | 2/2003 | Djordjevic | 123/447 |

FOREIGN PATENT DOCUMENTS

| | | |
|---|---|---|
| DE | 195 12 270 A1 | 9/1996 |
| DE | 199 23 951 A1 | 11/2000 |
| DE | 100 61 873 A1 | 6/2002 |
| WO | WO 2004/013487 A1 | 2/2004 |

* cited by examiner

*Primary Examiner*—Stephen K Cronin
*Assistant Examiner*—Anthony L Bacon
(74) *Attorney, Agent, or Firm*—Ronald E. Greigg

(57) ABSTRACT

The invention relates to a fuel-injection system (102), in which a rail (120) is provided for each injector between a high-pressure fuel pump (111) and said injectors (116).

9 Claims, 4 Drawing Sheets

FUEL INJECTION SYSTEM WITH A PLURALITY OF PRESSURE RESERVOIRS

CROSS-REFERENCE TO RELATED APPLICATION

This application is a 35 USC 371 application of PCT/EP 2005/055412 filed on Oct. 20, 2005.

BACKGROUND OF THE INVENTION

1. Field of the Invention

The invention is based on a fuel injection system for an internal combustion engine, having a high-pressure pump, having at least two injectors, and having a pressure reservoir disposed between the high-pressure pump and the at least two injectors.

2. Description of the Prior Art

Fuel injection systems of the type with which this invention is concerned are known from the prior art and are typically called common rail fuel injection systems. A known common rail fuel injection system of an internal combustion engine (not shown) will be explained with reference to FIG. 5. This fuel injection system 102 includes a fuel tank 104, from which fuel 106 is pumped by an electrical or mechanical fuel pump 108. Via a low-pressure fuel line 110, the fuel 106 is pumped to a high-pressure fuel pump 111. From the high-pressure fuel pump 111, the fuel 106 reaches a common rail 114 via a high-pressure fuel line 112. A plurality of fuel injection nozzles according to the invention, or injectors 116, are connected at the common rail 114 and inject the fuel 106 into combustion chambers 118 of an internal combustion engine, not shown.

In the known fuel injection system 102, the common high-pressure reservoir or so-called common rail 114 is provided for all the injectors 116. It is from this structure that the term "common rail" for such fuel injection systems is derived.

SUMMARY AND ADVANTAGES OF THE INVENTION

In a fuel injection system according to the invention for an internal combustion engine, having a high-pressure pump, having at least two injectors, and having a pressure reservoir disposed between the high-pressure pump and the at least two injectors, the system is characterized in that a separate pressure reservoir is assigned to each injector. On account of this structure, a fuel injection system of this kind can be called a "multiple rail" fuel injection system.

Because each injector is assigned a pressure reservoir, this pressure reservoir can be adapted optimally in terms of elasticity and reservoir volume to the injector associated with it. The pressure reservoir can furthermore be located in the immediate vicinity of the injector, so that the injection of fuel into the injectors is not impaired by pressure waves that pass back and forth between the pressure reservoir and the injector.

Moreover, because each injector is assigned a separate pressure reservoir, each of these pressure reservoirs can be quite small on its own, so that as a rule it is easily possible to accommodate this pressure reservoir in the immediate vicinity of the injector in the engine compartment of a motor vehicle. As a result of the inventive structure of the fuel injection system, the influence of various injectors on one another in an internal combustion engine is greatly reduced, which has a favorable effect on the operating and emissions performance of the engine.

Because of the split-up design of the pressure reservoir according to the invention, it is also possible, regardless of the number of cylinders of the engine, to put together a fuel injection system with a plurality of identical components, namely a high-pressure pump, a plurality of structurally identical pressure reservoirs, and a plurality of structurally identical injectors. This reduces the number of parts, and considerable costs can be eliminated.

In an advantageous feature of the invention, it is provided that on each pressure reservoir, at least one first high-pressure connection and one branch for an injector are provided. As a result, it is possible to build in the pressure reservoir of the invention in between a high-pressure line in the injector, so that even mass-produced injectors and high-pressure pumps can be equipped with the pressure reservoir of the invention. All that is required as a result is to adapt the high-pressure lines to the new pressure reservoir.

An especially preferred variant embodiment of the fuel injection system of the invention provides that on each pressure reservoir, a second high-pressure connection is provided; and that the at least two pressure reservoirs are connected in series. As a result, the structural complexity and expense and the space required are reduced still further.

On the last pressure reservoir of a series of pressure reservoirs, in a further especially advantageous feature of the invention, a pressure sensor and/or a pressure regulating valve may be provided, so that the pressure in the high-pressure region of the fuel injection system can be detected and optionally regulated to a set-point value by means of a central component. As a result, the advantages of the invention can be implemented without increasing the requirements in terms of sensors and other hydraulic components.

To achieve the desired operating performance of the injector, the reservoir volume and the elasticity of the pressure reservoir are adapted to the injection quantities and the operating performance of the associated injector. It is especially advantageous if this pressure reservoir is produced by forming, in particular forging, or casting, in particular fine casting. As a result, a further-improved operating performance of the injectors is obtained, which has an advantageous effect on noise production, emissions, and fuel consumption, as well as the running smoothness of the engine.

Advantageous embodiments of the pressure reservoir of the invention provide that the pressure reservoir is produced by forging or casting. If needed, the reservoir volume can for instance be machined out of the blank by metal-cutting machining, such as drilling, milling, and/or turning on a lathe.

To simplify machining the reservoir volume particularly of the pressure reservoir, the first high-pressure connection and/or the second high-pressure connection and/or the branch can be welded to the reservoir volume. This multi-part design makes it possible to complete the reservoir volume before the high-pressure connections and the branch are welded on, so that very good accessibility to the reservoir volume during its production is achieved. Next, the high-pressure connections and/or the branch is welded to the reservoir volume. In this operation, care must taken that the weld seam be designed such that no splashes of welded material can get into the reservoir volume, since such splashes could cause disruptions to the functioning of the injectors.

Alternatively, it is possible that the first high-pressure connection and/or the second high-pressure connection and/or the branch is screwed to the reservoir volume. Which one of these methods will be given preference in an individual case depends on the circumstances of the individual case.

The functionality of the pressure reservoir of the invention can be further improved if in each pressure reservoir, one fuel filter is provided. To that end, in a further advantageous feature of the pressure reservoir of the invention, in each pressure reservoir, one filter bore is provided for receiving the fuel filter. In this case, rod filters or screen filters can for instance be used.

BRIEF DESCRIPTION OF THE DRAWINGS

Further advantages and advantageous features of the invention can be learned from the description contained herein below, taken in conjunction with the drawings, in which.

DESCRIPTION OF THE PREFERRED EMBODIMENTS

Figure 1:
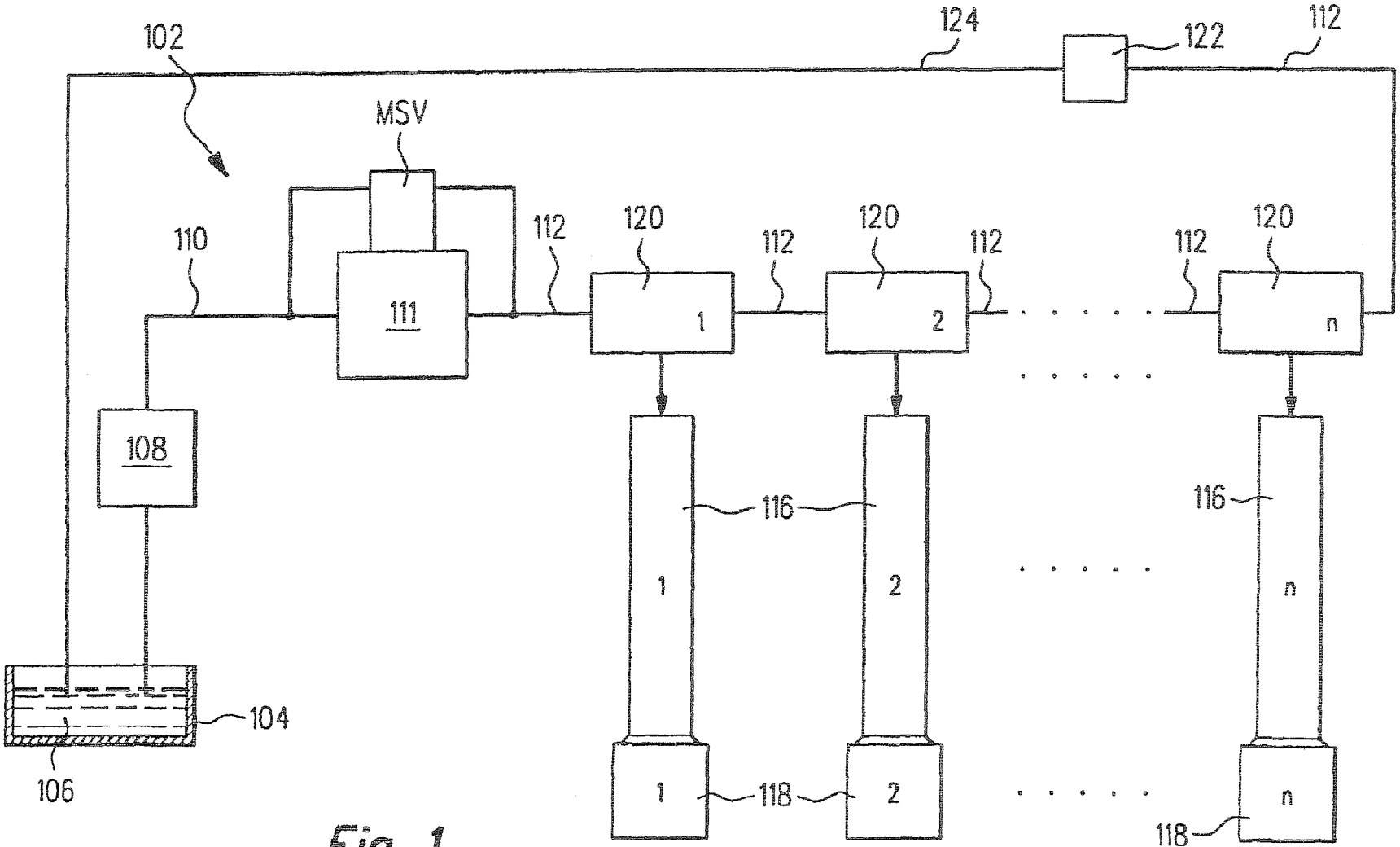
FIG. 1 shows a schematic view of a fuel injection system of the invention.
Figure 5:
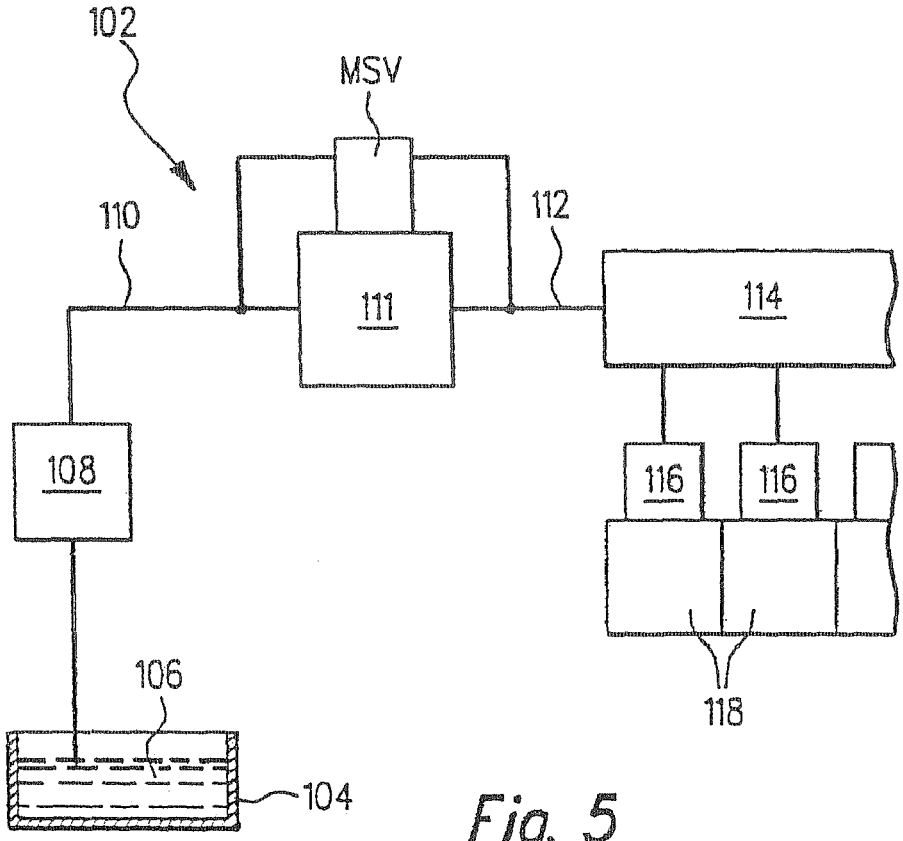
Fig. 5 PRIOR ART
FIG. 5 shows a common rail fuel injection system of the prior art.

In FIG. 1, a fuel injection system 102 according to the invention is shown, highly simplified, in the form of a block circuit diagram. From the fuel tank 104 to the high-pressure fuel pump 111 with the quantity control valve MSV, the fuel injection system of the invention is constructed identically to the common rail fuel injection system described above in conjunction with FIG. 5. The injectors 116 and the combustion chambers 118 of the engine are also the same.

The essential distinction is that instead of a common rail 114 (see FIG. 5), which supplies all the injectors 116 of an internal combustion engine with fuel that is under pressure, in the fuel injection system of the invention shown in FIG. 1, each injector 116 is assigned a separate pressure reservoir 120. In FIG. 1, the injectors 116, combustion chambers 118, and pressure reservoirs 120 are sequentially numbered. In an engine with "n" combustion chambers 118, there are accordingly "n" injectors 116 and "n" pressure reservoirs 120.

In other words, each injector 116 is assigned a respective pressure reservoir 120, which in terms of reservoir volume and elasticity cooperates optimally with the injector 116. Since the injectors 116 of one internal combustion engine are structurally identical, naturally the pressure reservoirs 120 of an internal combustion engine can also be embodied as structurally identical. Because the required reservoir volume is split up among a plurality of pressure reservoirs 120, it is also possible to dispose the pressure reservoirs 120 closer to the associated injectors 116. This has advantages in operating performance, since—compared with a fuel injection system of FIG. 5—the pressure fluctuations between the pressure reservoir and the injector 116 have a much shorter transit time, so that these pressure fluctuations have no interfering influences on the operating performance of the injectors 116.

In the exemplary embodiment of FIG. 1, the pressure reservoirs 120 numbered 1, 2, -n are connected in series. This means that each pressure reservoir 120 has a first high-pressure connection and a second high-pressure connection. One high-pressure fuel line 112 is connected to each of these high-pressure connections (not shown in FIG. 1). One high-pressure fuel line 112 connected to the last pressure reservoir 120 in this series, numbered "n" discharges into a pressure regulating valve 122. A pressure sensor (not shown) can be integrated with this pressure regulating valve 122 as needed. As a result, it is possible with only a single pressure regulating valve 122 and one pressure sensor to the regulate and/or measure the pressure in the high-pressure region of the fuel injection system 102.

On the output side, the pressure regulating valve 122 communicates with a relief line 124 that discharges into the fuel tank 104. Since intrinsically the pressure reservoirs 120 occur in the same numbers as the injectors 116, and this number is markedly higher than in the common rail 114 in the fuel injection system of the prior art, considerably more money can be invested into automating the production of these pressure reservoirs 120, so that a substantial proportion of the additional costs that occur from increasing the number of pressure reservoirs can be compensated for by the more-extensive automation of the process.

A further major cost advantage is obtained because, regardless of the number of cylinders of the engine, only structurally identical pressure reservoirs 120 are needed. Thus only a very few variants of pressure reservoirs 120 according to the invention are necessary, which leads to further-increased numbers of a given part and hence to reduced costs per part for the pressure reservoirs 120 of the invention.

Because short segments of the high-pressure fuel line 112 are located between the pressure reservoirs 120, the pressure reservoirs 120 also have only very little influence on one another. This is true especially because two injectors located adjacent one another typically do not inject fuel in succession; instead, given the order of ignition in multi-cylinder internal combustion engines, two cylinders and two injectors 116 that inject fuel into the combustion chambers 118 in rapid succession are as a rule located spatially relatively far apart.

Figure 2:
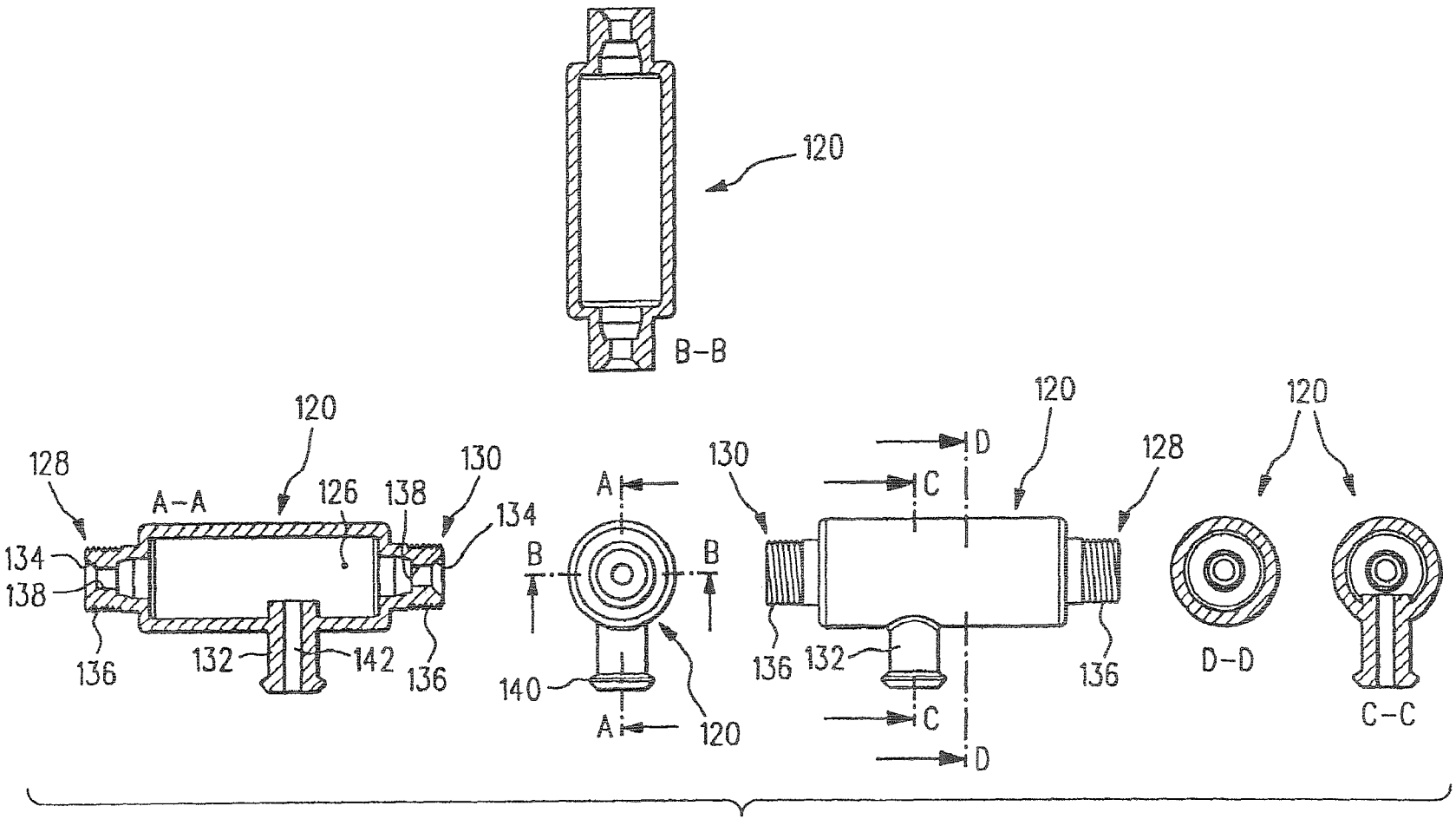
FIG. 2 shows a first exemplary embodiment of a pressure reservoir of the invention in various views.

In FIG. 2, a first exemplary embodiment of a pressure reservoir 120 of the invention is shown in various views. The pressure reservoir 120 of the invention essentially comprises a reservoir volume 126, a first high-pressure connection 128, a second high-pressure connection 130, and branch 132.

The first high-pressure connection 128 and the second high-pressure connection 130 are structurally identical and essentially have a frustoconical sealing face 134. A nipple, not shown, of the high-pressure fuel line 112 is pressed against this sealing face. This can be done for instance with the aid of a union nut, not shown, which is screwed onto a male thread 136 of the respective high-pressure connections 128 and 130.

In the exemplary embodiment of the pressure reservoir 120 of the invention shown in FIG. 2, the branch 132 and the high-pressure connections 128 and 130 are all produced by forging or some other forming process. For instance, it would be possible first to forge a blank into a cylindrical shape, creating the reservoir volume 126. Next, in a further forming process, the branch 132 is produced. In ensuing machining steps, by upsetting or some other forming process, the diameter at the end of the pressure reservoir 120 can now be reduced enough that the first high-pressure connection 128 and the second high-pressure connection 130 are formed. The sealing seat 134 and the through bore 136 in the high-pressure connections 128 and 130, which establish the hydraulic communication with the reservoir volume 126, can also be produced by forming or by metal-cutting shaping.

An encompassing bead 140 is provided on the branch 132. For connecting the branch 132 to an injector 116 in fluid-tight fashion, a union nut, not shown, can be slipped onto the branch 132, and a split ring (not shown) can then be placed between the union nut (not shown) and the bead 140. Next, the union nut can be screwed to a high-pressure connection of an injector 116.

In the interior of the branch 132, a so-called filter bore 142 is provided. This filter bore 142 first makes a hydraulic communication between the reservoir volume 126 and the branch 132. Furthermore, it is possible to press-fit a filter (not shown), for instance a rod filter or a screenlike filter, into the filter bore 142. As a result, it is highly reliably prevented that contaminants from the fuel can get into the connected injector 116 (see FIG. 1).

Figure 3:
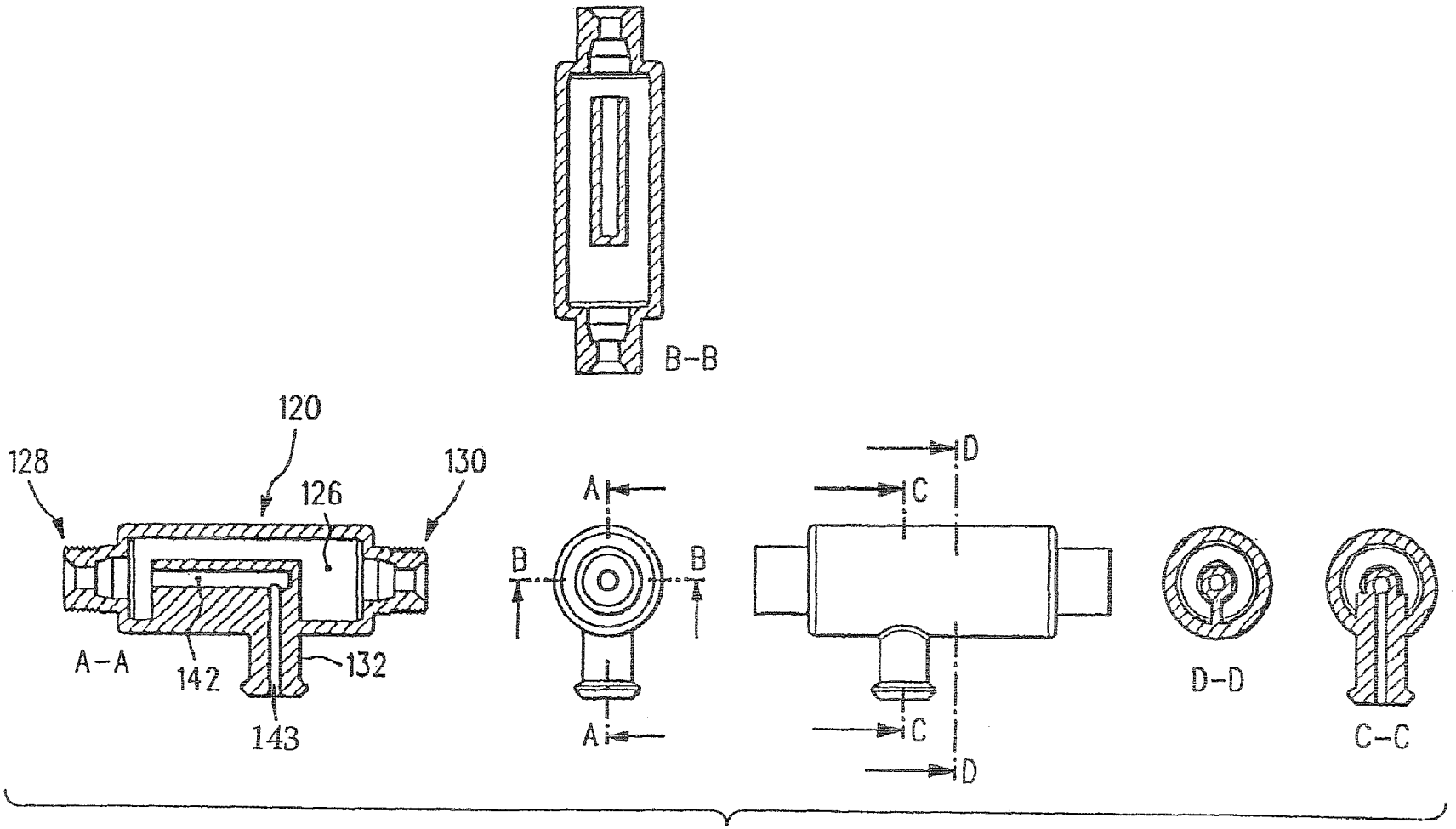
FIG. 3 shows a second exemplary embodiment of a pressure reservoir of the invention in various views.

In FIG. 3, a second exemplary embodiment of a pressure reservoir 120 of the invention is shown. An essential distinction between these first two exemplary embodiments is that the filter bore 142 in the exemplary embodiment of FIG. 3 is disposed in the longitudinal axis of the pressure reservoir 120. From this filter bore 142, a connecting bore 143 extends through the branch 132, so that in this way the hydraulic communication between the reservoir volume 126 and the branch 132, or the injector 116 connected to it, is established. Although the internal contour of this second exemplary embodiment of a pressure reservoir 120 of the invention is somewhat more complex, this component can also be produced by forming, If necessary, metal-cutting machining operations can be performed on the pressure reservoir 120 after the forming.

Figure 4:
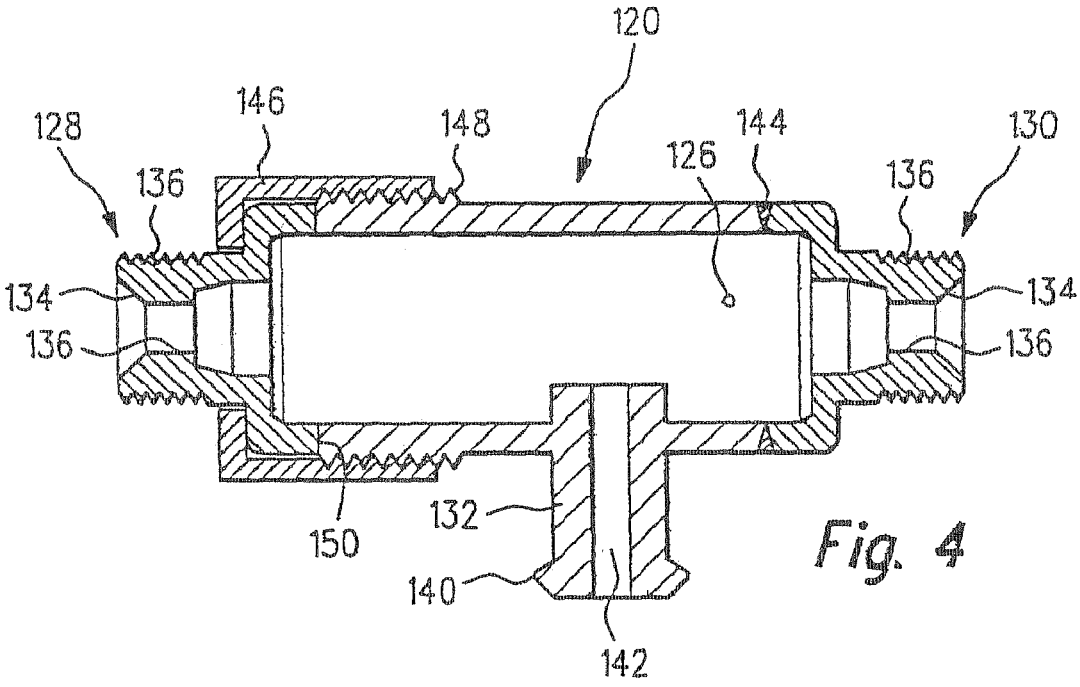
FIG. 4 is an enlarged view of a multi-part pressure reservoir according to the invention.

In FIG. 4, further variant embodiments of pressure reservoirs 120 of the invention are shown. The essential characteristic of this pressure reservoir 120 is its multi-part construction. On the right-hand side in FIG. 4, the second high-pressure connection 130 is welded to the reservoir volume 126. The weld seam is identified in FIG. 4 by reference numeral 144. It is understood that in the welding of the second high-pressure connection 130 to the actual pressure reservoir 120, care must be taken that splashes of welded material not be able to get inside the reservoir volume 126. These splashes could in fact otherwise possibly get inside the injector 116, where they could cause premature wear or functional problems.

The first high-pressure connection 128 in the exemplary embodiment of FIG. 4 is screwed and braced with a union nut 146, which cooperates with a male thread 148 of the pressure reservoir 120. At a sealing face 150 between the first high-pressure connection 128 and the pressure reservoir 120, a bite edge, a fitting or other designs known from the prior art may be provided. This bite edge and fitting are not visible in detail in FIG. 4. What is important, however, is that even under severe, increasing pressure stresses, the sealing face 150 remains tight over the entire service life.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection system for an internal combustion engine, the system comprising a high-pressure pump, a plurality of injectors, and a plurality of pressure reservoirs equal in number to the number of injectors for supplying fuel from the high-pressure pump to the injectors, a different one of the plurality of pressure reservoirs being disposed between the high-pressure pump and each of the plurality of injectors, each pressure reservoir having at least one first high-pressure connection, at least one second high-pressure connection and one branch for an injector, means for connecting the plurality of pressure reservoirs in series, a fuel filter in each pressure reservoir, one filter bore provided in each pressure reservoir for receiving the fuel filter, and wherein each fuel filter is embodied as a rod filter or as a screen filter.

2. The fuel injection system as defined by claim 1, further comprising a fuel-filled reservoir volume in each pressure reservoir.

3. The fuel injection system as defined by claim 2, wherein the reservoir volume and an elasticity of the pressure reservoir are adapted to the associated injector.

4. The fuel injection system as defined by claim 1, wherein each of the pressure reservoirs is produced by forging or casting.

5. The fuel injection system as defined by claim 2, wherein each of the pressure reservoirs is produced by forging or casting.

6. The fuel injection system as defined by claim 1, wherein at least one of the first high-pressure connection, the second high-pressure connection and the branch is welded to the reservoir volume.

7. The fuel injection system as defined by claim 2, wherein at least one of the first high-pressure connection, the second high-pressure connection and the branch is welded to the reservoir volume.

8. The fuel injection system as defined by claim 1, wherein at least one of the first high-pressure connection, the second high-pressure connection and the branch is screwed to the reservoir volume.

9. The fuel injection system as defined by claim 2, wherein at least one of the first high-pressure connection, the second high-pressure connection and the branch is screwed to the reservoir volume.

* * * * *